US006547179B1

(12) United States Patent
Klas

(10) Patent No.: US 6,547,179 B1
(45) Date of Patent: Apr. 15, 2003

(54) METHOD AND APPARATUS FOR SHORTENING THE SPLICE TAIL IN A FLYING SPLICE ROLL CHANGER

(75) Inventor: Ernst Klas, Siegburg (DE)

(73) Assignee: Vits Maschinenbau GmbH, Langenfeld (DE)

( * ) Notice: Subject to any disclaimer, the term of this patent is extended or adjusted under 35 U.S.C. 154(b) by 0 days.

(21) Appl. No.: 09/601,579

(22) PCT Filed: Jan. 23, 1999

(86) PCT No.: PCT/EP99/00436

§ 371 (c)(1),
(2), (4) Date: Aug. 2, 2000

(87) PCT Pub. No.: WO99/40004

PCT Pub. Date: Aug. 12, 1999

(30) Foreign Application Priority Data

Feb. 5, 1998 (DE) ..... 198 04 415

(51) Int. Cl.[7] ..... B65H 19/20
(52) U.S. Cl. ..... 242/555.3; 242/554.2
(58) Field of Search ..... 242/554.2, 555, 242/555.1, 555.2, 555.3, 555.4, 555.5, 555.6, 555.7

(56) References Cited

U.S. PATENT DOCUMENTS 3,915,399 A * 10/1975 Kron et al. ..... 242/555.5
5,779,184 A * 7/1998 Kaufmann ..... 242/554.2

FOREIGN PATENT DOCUMENTS

| | | |
|---|---|---|
| DE | 20 23 100 B2 | 12/1971 |
| DE | 25 19 057 A1 | 11/1976 |
| DE | 26 19 236 C3 | 11/1977 |
| DE | 29 11 268 A1 | 10/1980 |
| EP | 0 662 437 A1 | 7/1995 |
| WO | WO 93/25460 | 12/1993 |

* cited by examiner

*Primary Examiner*—John M. Jillions
(74) *Attorney, Agent, or Firm*—Herbert Dubno

(57) ABSTRACT

In a flying splice roll changer a splice tail occurs at the splice joint that may induce problems in a downstream processing station. The present invention is directed to shortening of the splice tail (2) by directing the paper web (1) around a deflection roller (3) so that the splice tail (2) is located on the outer face of the roller and extends radially under the action of centrifugal force while being optionally supported by air ejected from blowing nozzles (8, 9). The splice tail is then cut with a blade (7) located in the vicinity of the outer surface of the deflection roller (3) so that only an insignificant length of a few millimeters remains.

15 Claims, 5 Drawing Sheets

METHOD AND APPARATUS FOR SHORTENING THE SPLICE TAIL IN A FLYING SPLICE ROLL CHANGER

CROSS REFERENCE TO RELATED APPLICATIONS

This application is a national stage of PCT/EP99/00436 filed Jan. 23, 1999 and based upon German national application 198 04 415.1 filed Feb. 5, 1998 under the International Convention.

FIELD OF THE INVENTION

The invention relates to a method and to a device for shortening the splice tail resulting from a flying roll change.

BACKGROUND OF THE INVENTION

Continuously working paper processing machines, particularly rotary web-fed machines, are fed with paper webs which are unwound from rolls. When a roll is finished, it is replaced by a new roll without stopping the processing machine. Roll changers are known which work with a so-called "flying roll exchange". The initial portion (leading end) of a new roll in stand-by position is first provided with an adhesive point. Then the new roll is set into rotation and brought to a peripheral speed which is synchronized with the speed of the web reeling off the almost empty roll. At the right moment the unwinding web is pressed against the new roll, so that it touches the same in the area of the adhesive point. The initial portion of the new web is thus glued to the reeling-off web. The reeling-off web is cutoff shortly behind of the splicing point.

According to DE 26 19 236 C3 which describes a roll changer with the pertaining control system, the segment of the old web defined as the so-called "splice tail" should have a predetermined length from the adhesive point to the separated end so that when the splice tail passes through the printing machine no disturbances occur.

However it has been found that the tails cause disturbances in the subsequent processing stations even when they all are of equal, prescribed lengths. Since the cut always occurs with a delay due to the inert mass of the cutting device and to the cycle timing of the control system, the tail cannot be cut off as short as desired. If for instance the delay time is 10 ms and the web speed is 15 m/s, then the tail is at least 150 mm long.

According to the DE 29 11 268 A1, which describes a similar roll changer, during the nonstop unwinding of the webs of material the tendency is to keep the tail as short as possible, since it can be damaging to further processing. According to the cited reference this problem is solved by arranging on the new roll behind the adhesive area a rip cord provided with an entrainment element. The latter remains attached to the pressure roller when the paper web is pressed against the new roll and activates the rip cord, so that it separates the paper web. This makes it possible to glue the reeling-off paper web to a new paper web without a splice tail.

However it has proven in practice that the efforts of the roll preparation, as well as the control of the rip cord after adhesion cause considerable expense, so that this method has not been validated.

OBJECTS OF THE INVENTION

Starting from the idea that the formation of a troublesome tail can be hardly avoided with present technical means, it is the object of the invention to provide a method which will shorten the tail to an acceptable length, before it reaches the downstream processing stations. It is also an object to provide a suitable device for the implementation of the method.

SUMMARY OF THE INVENTION

This object is achieved in a method of shortening the splice tail following a flying roller change, whereby a running paper web is taken up from a roll approaching its end and fed to a processing station, pressed against the glue-covered initial portion (leading end) of a new roll synchronized with the travelling paper web and subsequently trimmed after a short interval. According to the invention, the paper web is guided through a curved portion of a path, whose center lies on the side of the web facing away from the tail so that the tail raised by the centrifugal force is cut off close to the curved portion. Between the paper web and the tail an air blast can be blown in the direction of the web travel. Due to suction the tail can adhere to the side facing away from the center of the curvature. The tail can be braked due to friction with a surface at rest or moving slower than the paper web. The tail can be accelerated by a frictional locking with a surface moving faster than the paper web.

The device for shortening the splice tail is located downstream of an unwinding device which is equipped with means for flying roll exchange, wherein a passing paper web taken up from a roll approaching its end and fed to a processing station is pressed against the glue-covered initial portion of a new roll synchronized with the paper web and is subsequently trimmed after a short time interval. This device is characterized by a guide roller and a knife arranged at a short distance from the shell surface of the guide roller. The blade of the knife is serrated. At a distance from the blade of the knife at least one blast nozzle is arranged and can have blast openings for blowing an air blast in the running direction of the paper web. A suction box with a suction slot can be located in the immediate vicinity of the blade of the knife. Upstream of the blade of the knife, at a distance from the paper web, a suction belt can be arranged which runs approximately tangentially to the guide roller. The suction belt can revolves at a speed which is higher than the peripheral speed of the guide roller. Upstream of the blade of the knife, at a distance from the guide roller a cylinder can be arranged parallel thereto. The shell of the cylinder can be provided with a friction-enhancing coating. The shell of the cylinder can be is perforated and the interior of the cylinder can be connected to a suction device. Two guide roller can be provided, between which the paper web runs through a rectilinear portion. A suction box with a perforated suction wall can be located at a distance from and oppositely to the paper web covering the length of the rectilinear portion, and by a knife, can be arranged at a short distance from the subsequent guide roller.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
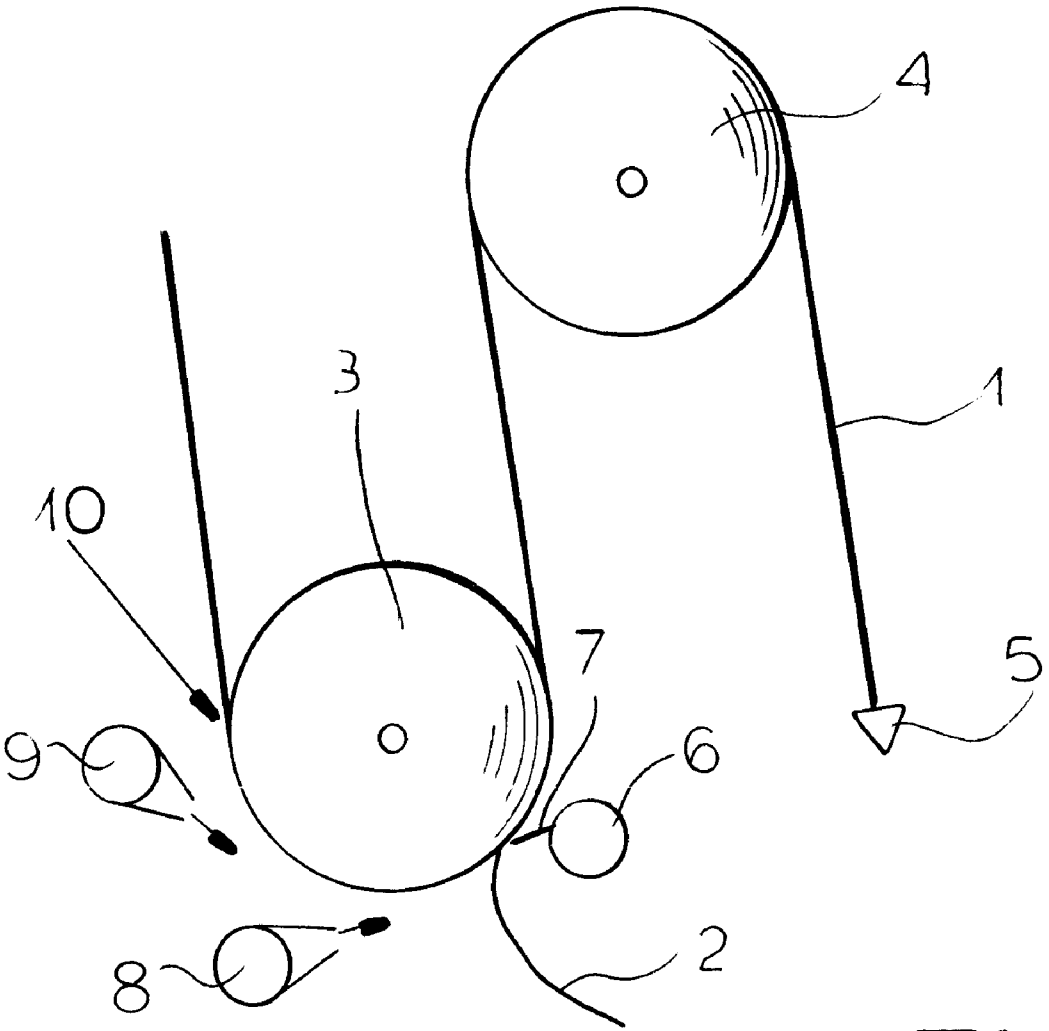
FIG. 1 is a schematic side view showing a first embodiment of a device for carrying out the method.

According to FIG. 1 a paper web 1 coming from a roll changer not shown in the drawing, to which a tail 2 is still attached is guided over a guide roller 3 in such a way that the tail is on the outside, i.e. on the side facing away from the center of curvature. The paper web 1 wraps around the guide roller 3 over an angle of approximately 180°. Subsequently the web reaches a roller 4, is there again deflected and further guided approximately parallel to the direction in which it runs towards the guide roller 3, for instance to a web-fed rotary machine.

In a holder 6 arranged parallel to the guide roller 3 a knife 7 is fastened, whose blade reaches into the wrap-around area, close to the shell surface of the guide roller 3. Between the blade of knife 7 and the shell surface of guide roller 3 there is only a short distance, e.g. approximately 2 mm. Preferably the blade of the knife 7 is serrated and extends over the entire work width. It points in a direction which is substantially tangential, opposite to the motion of the paper web 1.

Close to the guide roller 3 there are two blast nozzles 8, 9, each provided with a nozzle slot or with a row of nozzle openings, arranged so that exiting nozzle blasts graze the shell surface of the guide roller 3 in the wrap-around area located between the leading line 10 of the paper web 1 and the blade of knife 7.

The device works as follows: As soon as the initial porion of the tail 2 has passed the leading line 10 at high speed, e.g. 15 m/s, the tail is set into a whip-like motion, on the one hand due to the centrifugal force, on the other hand due to the resistance of the surrounding air. Before the initial portion of the tail 2 reaches the knife 7, the tail 2 is impacted from behind with air blasts by the blast nozzles 8, 9, whose speed is clearly higher than the speed of the paper web 1. The tail is thereby raised at least approximately radially and in this orientation reaches the blade of knife 7. There it is cut off so that only an insignificant residue of a few mm remains. In the further Figures the reference numerals which are already used in FIG. 1, designate the same parts as in FIG. 1. Therefore a repeated description of these parts is not necessary.

Figure 2:
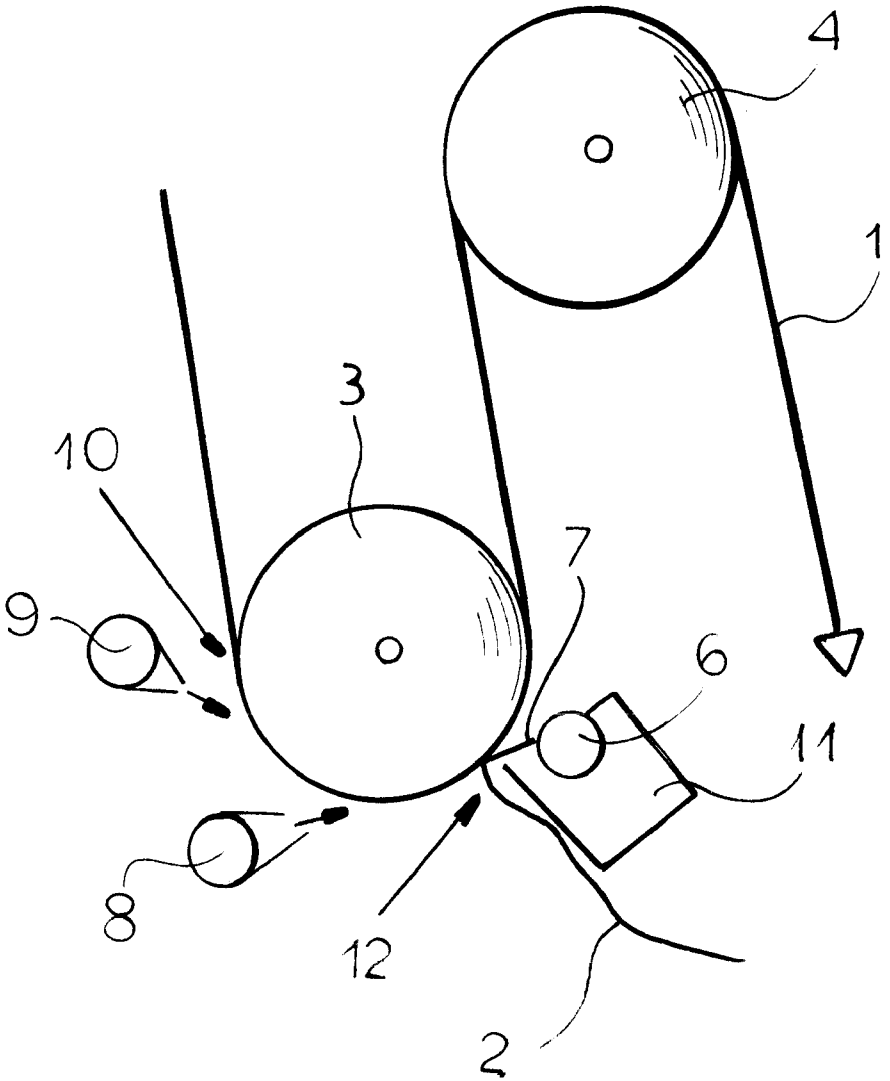
FIGS. 2 to 5 are similar views of other embodiments.

The embodiment according to FIG. 2 differs from the one illustrated in FIG. 1 in that the holder 6 of knife 7 is fastened to a suction box 11. Its inner space is connected with a suction device not shown in the drawing. It has a suction slot 12 located immediately next to the knife 7.

When in operation, as soon as the tail 2 approaches the suction box 11 inside the same a negative pressure is generated, so that through the suction slot 12 air is aspired. This reduces the air resistance which acts to induce radial lifting of the tail 2 and makes it easier to cut off the tail 2.

Figure 3:
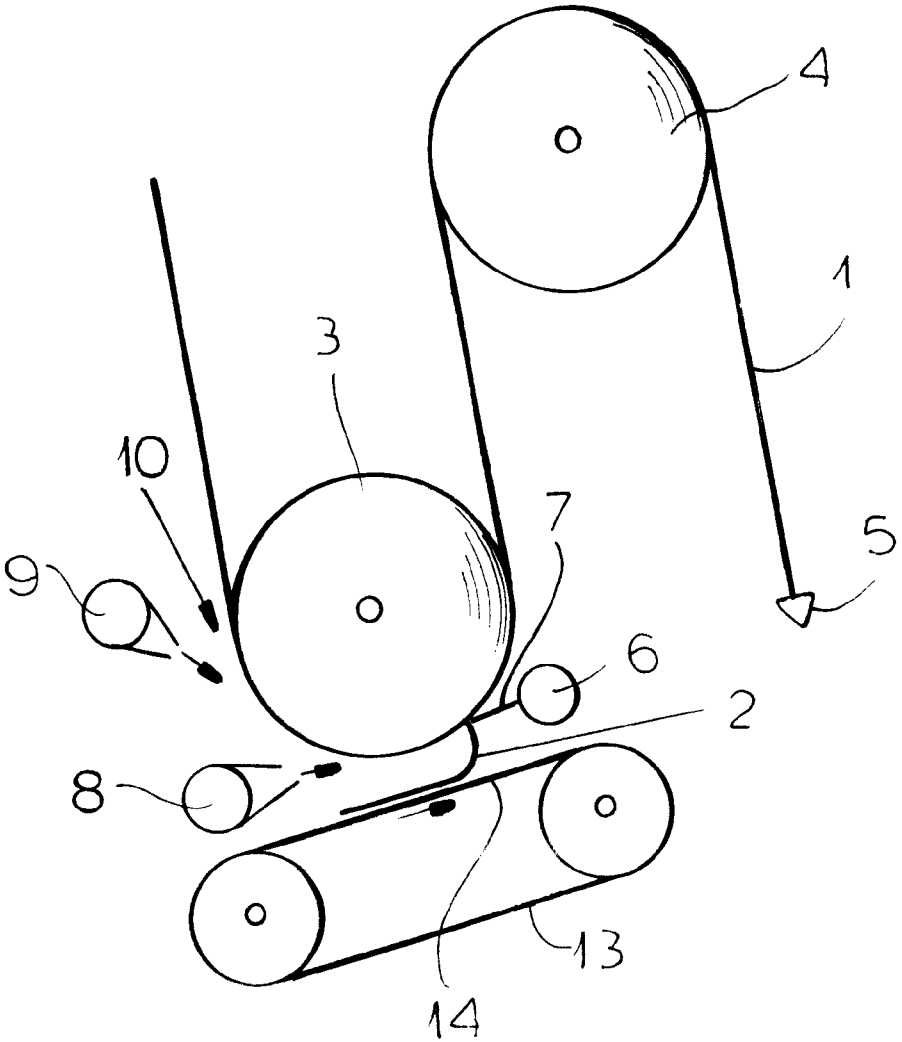

In the embodiment of FIG. 3, the guide roller 3 is associated with an endlessly revolving suction belt 13. The active strand of the suction belt runs at a distance of approximately 20 to 60 mm parallel to a tangent which touches the shell of the guide roller 3 at a point located in the wrap-around area shortly before the knife 7. Between the active strand 14 and the other returning strand, a conventional suction box is arranged, which is open on the side towards the active strand.

In operation, under the action of the centrifugal force and of the air blasts exiting from the blast nozzles 8, 9, the tail 2 is separated with its free end from the paper web 1 pressed against the guide roller 3 and thrown against the active strand 14 of the suction belt 13. There the tail is held by the suction effect.

Preferably the suction belt 14 is driven at a speed which is higher then the peripheral speed of the guide roller 3. As a result the tail 2 is pulled over the knife, so that a secure cut is insured in the immediate vicinity of the initial portion of tail 2.

However the suction belt 13 can also run at a speed which is lower than the peripheral speed of the guide roller 3. In this case the free end of the tail 2 is braked, and the tail 2 is kept taut. This also facilitates a precise cut-off of the tail.

Figure 4:
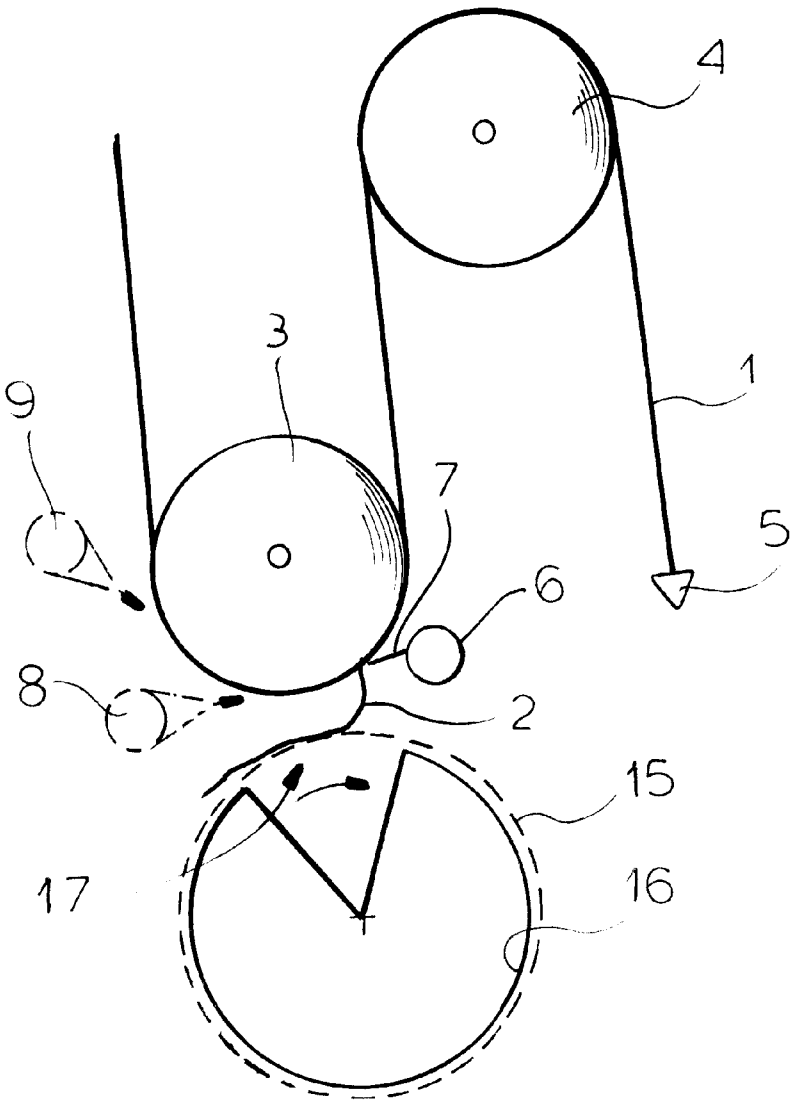

The embodiment of FIG. 4 differs from the just described embodiment according to FIG. 3 in that the suction belt 13 is replaced by a rotating cylinder 15. It has a perforated shell and is connected to a suction device not shown in the drawing. Inside the cylinder 15 a baffle plate 16 is arranged, which leaves merely a suction zone 17 extending over an angle range of about 60° and is located approximately opposite to the middle portion of the wrap-around area of the guide roller 3. The shell of cylinder 15 can be provided with a friction-enhancing coating, e.g. a rubber layer.

The function is so similar to the function of the embodiment example of FIG. 3, that further explanations are not necessary. It may be mentioned that due to the friction-enhancing layer combined with the suction effect, the tail 2 is immovably held on the cylinder 15.

In a simplified embodiment, the cylinder 15 has an impermeable, preferably rubberized shell. The baffle plate 16 is missing, and naturally so is the connection to the suction device.

In this case the cylinder 15 acts only as a support and conveying member for the tail 2. It can be synchronized with the guide roller 3 with respect to the peripheral speed, but can also lead or trail. In this case it contributes to guiding the tail 2 towards the knife 7 in a reproducible position favoring the cut.

Figure 5:
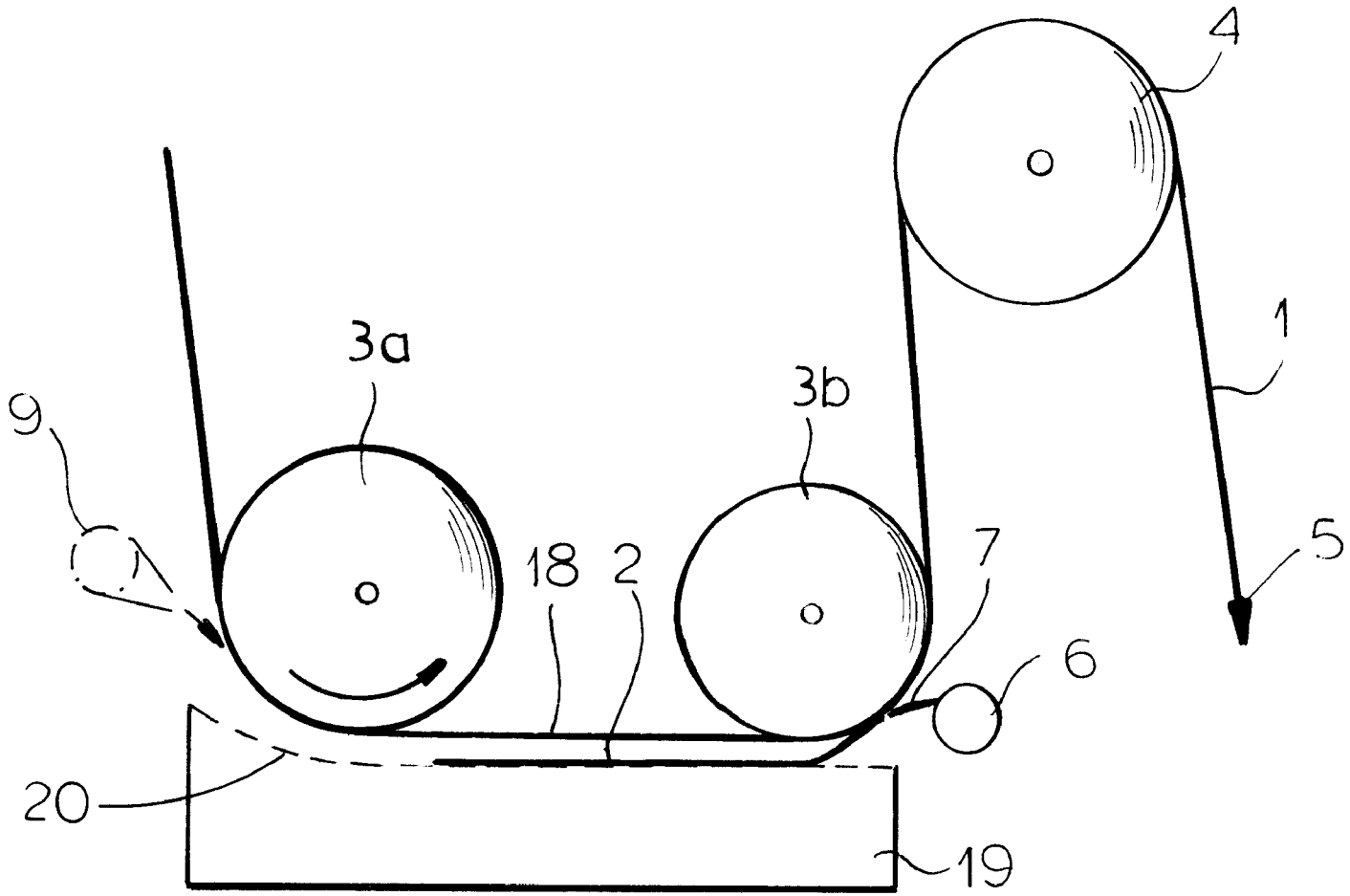

The embodiment of FIG. 5 shows two guide rollers 3*a*, 3*b*, whereby the guide roller 3*a* precedes the guide roller 3*b* in the web travel direction. The paper web 1 wraps around both guide rollers 3*a*, 3*b*, in each case each at an angle range of approximately 90°, so that the web is guided by the subsequent guide roller 3*b* in the opposite direction to the one it is guided towards the first guide roller 3*a*. Between the guide rollers 3*a*, 3*b* rotating in the same sense, the paper web passes through a rectilinear path segment 18. Next to the same a suction box 19 with a perforated suction wall 20 is arranged. The suction wall faces the side of the paper web which at the moment passes through the rectilinear path segment 18. The distance between the paper web 1 and the suction wall 20 is of approximately 20 to 50 mm. Next to the preceding guide roller 3*a* a blast nozzle 9 is arranged, whose blast is directed into the wedge between the guide roller 3*a* and the suction wall 20. Next to the following guide roller 3*b* a knife 7 is arranged.

In this embodiment the separation of the tail 2 from the paper web 1 takes place at the first guide roller 3*a* due to centrifugal force supported by the effect of the air blast exiting the blast nozzle 9. The free end of the tail 2 is held on the suction wall 20. As a result the tail 2 is guided to the knife 7 in a taut state.

What is claimed is:

1. In a method of effecting a flying roll change and shortening the splice tail which comprises the steps of:

(a) taking up a paper web from a depleted roll upon approach of an end of the roll; and (b) pressing the taken-up paper web against a glue-covered initial portion of a new roll synchronized in speed with the depleted roll in a flying roll change, thereby forming a running paper web with a splice tail, (c) guiding the running paper web around a curved path with a center of curvature lying on a side of the paper web facing away from said splice tail so that said splice tail rises from said paper web by centrifugal force; and (d) cutting off the splice tail raised from said paper web close to said curved path.

2. The method defined in claim 1, further comprising the step of blowing an air blast against said paper web at said splice tail in a direction of travel of said paper web in a region at which said splice tail is cut off from the paper web.

3. The method defined in claim 1, further comprising applying suction to said splice tail at a side of said paper web facing away from said center of curvature.

4. The method defined in claim 1, further comprising the step of frictionally braking said splice tail with a friction surface engaging said splice tail.

5. The method defined in claim 1, further comprising the step of accelerating said splice tail by frictionally locking said splice tail to a surface moving faster than said paper web.

6. In an unwinding apparatus for a paper web wherein the paper web is taken up from a depleted roll upon approach of an end of the depleted roll and the taken-up paper web is pressed against a glue-covered initial portion of a new roll synchronized in speed with the depleted roll, thereby forming a running paper web with a splice tail in a flying roll change, a device for shortening the splice tail which comprises:

a guide roller forming a curved path with a center of curvature lying on a side of the paper web facing away from said splice tail so that said splice tail rises from said paper web by centrifugal force; and a knife arranged close to said path and a surface of said guide roller and having a blade directed against a traveling direction of the paper web for cutting off the splice tail raised from said paper web close to said curved path.

7. The device defined in claim 6 wherein said blade is serrated.

8. The device defined in claim 6, further comprising at least one blast nozzle disposed to blow an air blast in said direction in a region of said knife.

9. The device defined in claim 6, further comprising a suction box having a suction slot disposed in an immediate vicinity of said blade.

10. The device defined in claim 6, further comprising a suction belt upstream of said blade and spaced from said paper web and running substantially parallel to a tangent to said guide roller.

11. The device defined in claim 10 wherein said suction belt is displaced at a speed greater than the peripheral speed of said guide roller.

12. The device defined in claim 6, further comprising a cylinder disposed parallel to said guide roller and spaced therefrom upstream of said blade for engaging said splice tail.

13. The device defined in claim 12 wherein said cylinder has a surface provided with a friction-enhanding coating.

14. The device defined in claim 12 wherein said cylinder has a perforated shell and is internally connected to a suction device.

15. The device defined in claim 6 wherein said paper web passes around two guide rollers and said path has a rectilinear portion between said guide rollers, said device further comprising a suction box having a perforated suction wall from said rectilinear portion and engaging said splice path.

* * * * *